US005158325A

United States Patent [19]

Landis et al.

[11] Patent Number: 5,158,325

[45] Date of Patent: Oct. 27, 1992

[54] ADJUSTABLE SIZE BOOK JACKET

[76] Inventors: Mary L. Landis, 1444 Mohawk Dr., Port Charlotte, Fla. 33952; Louise Petro, 7200 Reymoor Dr., North Fort Myers, Fla. 33917

[21] Appl. No.: 527,537

[22] Filed: May 22, 1990

[51] Int. Cl.[5] ..... B42D 9/00; B42D 3/00

[52] U.S. Cl. ..... 281/42; 281/35; 281/34; 116/239

[58] Field of Search ..... 281/29, 34, 35, 42; 412/4, 19; 116/234, 238, 239; D19/34

[56] References Cited

U.S. PATENT DOCUMENTS

| | | | |
|---|---|---|---|
| D. 281,982 | 12/1985 | Hammond | D19/34 |
| 2,078,392 | 4/1937 | Lee | 116/239 |
| 2,394,372 | 2/1946 | Evans | 116/238 X |
| 2,457,662 | 12/1948 | Hamilton | 116/239 |
| 2,935,337 | 5/1960 | Ecllestone | 281/42 X |
| 3,011,471 | 12/1961 | Tam | 116/238 |
| 3,572,767 | 3/1971 | Learned et al. | 281/34 |
| 4,605,245 | 8/1986 | Weaver | 281/34 |

FOREIGN PATENT DOCUMENTS

| | | | |
|---|---|---|---|
| 1091364 | 4/1955 | France | 281/35 |
| 1202669 | 7/1959 | France | 281/35 |
| 2438549 | 6/1980 | France | 281/35 |

*Primary Examiner*—Mark Rosenbaum
*Assistant Examiner*—S. Thomas Hughes
*Attorney, Agent, or Firm*—William E. Noonan

[57] ABSTRACT

An adjustable size book jacket is disclosed including a first pouch section that is composed of an elastic material and has a first opening formed therein for receiving the front cover of a book and generally conforming to at least a portion of the periphery of the front cover. A second pouch section is composed of an elastic material and has a second opening formed therein for receiving the back cover of the book and generally conforming to at least a portion of the periphery of the back cover. A junction section interconnects the first and second pouch section and extends across the binding of the book when the front and back covers are received by the first and second pouch sections.

4 Claims, 3 Drawing Sheets

ADJUSTABLE SIZE BOOK JACKET

FIELD OF THE INVENTION

This invention relates to an adjustable book jacket, which is resiliently expandable to cover various sizes of books, and which is particularly well suited for covering and protecting school textbooks.

BACKGROUND OF THE INVENTION

A variety of jackets are presently used for covering and protecting books. Many school districts mandate the use of such book jackets in an attempt to minimize damage to increasingly expensive textbooks. However, conventional book jackets commonly exhibit a number of disadvantages. They are usually constructed of a fairly lightweight paper or plastic material that has a relatively short life span, particularly when subjected to wear and tear by school age students. Furthermore, assembling such book jackets is often a time consuming and annoying task. Fairly precise cutting, folding, taping and/or gluing are typically, required to insure that the jacket properly fits the book. And, traditional book jackets are not readily adaptable for subsequent reuse on books having different sizes. After a jacket which has been constructed to fit a particular book is removed from that book, it is typically discarded. This is economically and environmentally inefficient.

Certain book jackets have been constructed of more permanent materials. However, these products typically utilize a fairly intricate construction and are not conveniently adjustable, particularly for various sizes of school textbooks.

SUMMARY OF INVENTION

It is therefor an object of the present invention to provide an adjustable size book jacket, which may be used to fit and protect books having a wide variety of sizes.

It is a further object of this invention to provide an adjustable book jacket, which is rugged and long-lasting, and which may be reused repeatedly on successive books.

It is a further object of this invention to provide an adjustable book jacket, which is quickly and conveniently assembled, and which is readily and snugly fitted onto the book to be protected.

It is a further object of this invention to provide an adjustable book jacket, which is quicker and easier to fit onto a book than are conventional book jackets.

It is a further object of this invention to provide an adjustable book jacket, which may employ a variety of aesthetically pleasing designs.

It is a further object of this invention to provide a book jacket which not only covers and protects a book but also provides a non-removable means for marking the reader's place in the book.

This invention results from a realization that an improved, long lasting, adjustable size book jacket may be achieved by constructing the jacket of an elastic material, which may be fitted onto books of various sizes. Accordingly, this invention features an adjustable size book jacket, which includes a first pouch section composed of an elastic material and having a first opening formed therein for receiving the front cover of a book and generally conforming to at least a portion of the periphery of the front cover. There is a second pouch section composed of an elastic material and having a second opening formed therein for receiving the back cover of the book and generally conforming to at least a portion of the periphery of the back cover. A junction section interconnects the first and second pouch sections for extending across the binding of the book when the front and back covers are received by the first and second pouch sections.

In a preferred embodiment, each pouch section includes a generally sheet-like cover portion having a peripheral edge region and a generally sheet-like flap portion which has a first peripheral edge segment that generally conforms to and is secured to the peripheral edge region of the respective cover portion. The flap portion also includes a second peripheral edge segment that extends between ends of the first peripheral edge segment and generally across the respective cover portion. The second peripheral edge segment is separated from the cover portion to form a respective one of the first and second openings. The junction section is preferably elastic and integrally interconnects the respective cover portions of the first and second pouch sections. The junction section may include upper and lower edges and means for reinforcing the upper and lower edges. At least a portion of the first peripheral edge segment may be integrally connected to the peripheral edge region. Seam means may be provided for interconnecting at least a portion of the first peripheral edge segment and the peripheral edge region.

A book marking element may be connected to the junction section between the first and second pouch sections. The book marking element may be composed of an elastic material and may be attached integrally to the junction section.

DETAILED DESCRIPTION OF PREFERRED EMBODIMENT

Other objects, features and advantages will occur from the following description of a preferred embodiment and the accompanying drawings, in which.

Figure 1:
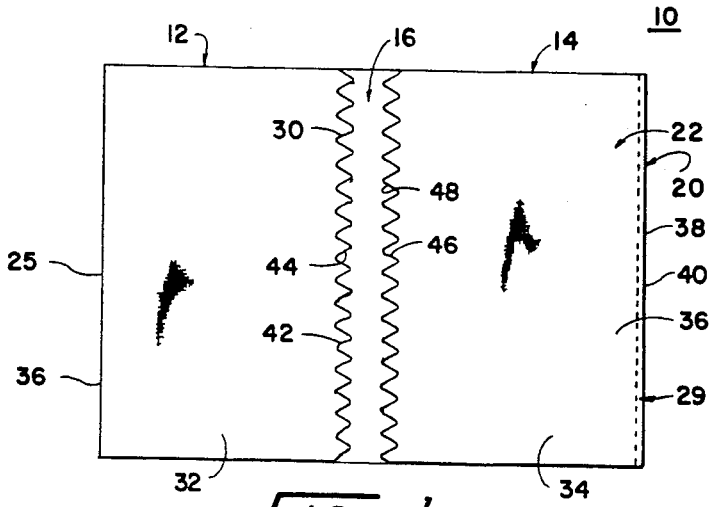
FIG. 1 is a perspective view of a preferred adjustable size book cover in accordance with this invention, with the inner flap part of the jacket being primarily depicted.

There is shown in FIG. 1 an adjustable size book jacket 10 including a first pouch section 12 and a second pouch section 14, which are integrally connected by a junction section 16. Pouch section 12 is designed for receiving the front cover of a book and pouch section 14 is designed for receiving the rear cover of the book, in a manner described more fully below.

Figure 2:
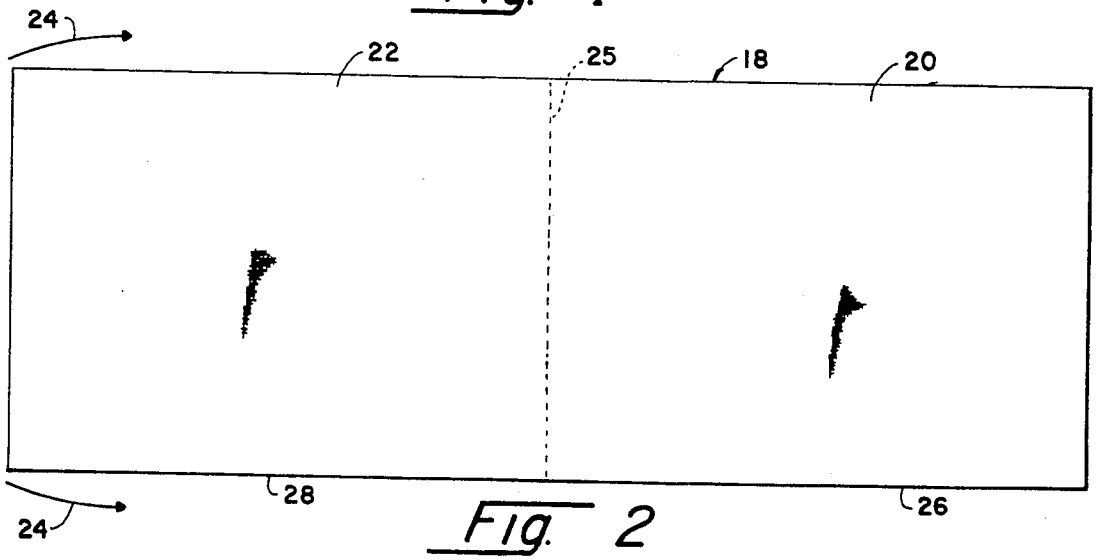
FIG. 2 is a plan view of an elastic piece of material, which is used to construct the book jacket.
Figure 3:
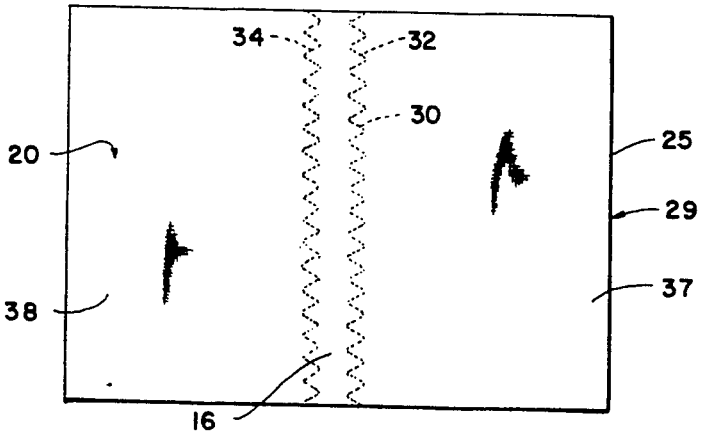
FIG. 3 is a plan view of the jacket of FIG. 1, with the outside cover part of the jacket being primarily depicted.

As shown in FIG. 2, book jacket 10 is formed from a single piece 18 of elastic, sheet-like material having a suitable and desired size and shape. The material 18 may include nylon, spandex or other durable elastic materials. Material 18 includes a cover forming part 20 and a flap forming part 22, which are integrally joined along transverse mid-line 25. Each part typically comprises approximately ½ of material 18. Cover part 20 has a peripheral edge 26, and flap part 22 has a peripheral edge 28 which generally conforms to the shape of edge 26. As shown in FIG. 2, part 22 is folded over part 20 in the direction of arrows 24 and material 18 is folded along line 25. As a result, material 18 assumes the peripheral shape shown in FIGS. 1 and 3. After the parts have been folded together, edges 26 and 28 are sewn, stitched or otherwise fixed together so that parts 20 and 22 are connected about the entire periphery 29 of the product. A transverse cut 30 is then formed in the middle of flap part 22. As a result, first and second sheet-like flap portions 32 and 34, FIG. 1, are formed. On the opposite side of the product, FIG. 3, cover part 20 includes a sheet-like first cover portion 37 that corresponds to flap portion 32, and a similar second cover portion 38 that corresponds to flap portion 34. Junction section 16 integrally interconnects cover portions 37 and 38. In alternative embodiments, the junction section may include a longitudinal seam for interconnecting the front and rear cover portions.

As best shown in FIG. 1, each of the cover portions 37, 38 includes a peripheral edge region 40, and each of the flap portions 32, 34 includes a complementary, conforming peripheral edge segment 36 which are secured together along either a seam or an integral fold, as previously described. As a result, cover portion 37 and flap portion 32 form first pouch section 12, and cover portion 38 and flap portion 34 form second pouch section 14. Flap portion 32 includes a second edge segment 42, which is formed by cut 30 and extends between the ends of edge segment 36. Edge segment 42 is separated from cover portion 37 so that an opening 44 is formed in pouch section 12 between the flap section 32 and the cover section 37. Pouch section 14 is similarly formed by flap portion 34 and corresponding cover portion 38. Flap portion 34 includes an edge segment 46 formed by cut 30. Edge segment 46 is separated from the cover portion 38 so that an opening 48 is formed in pouch section 14.

Figure 4:
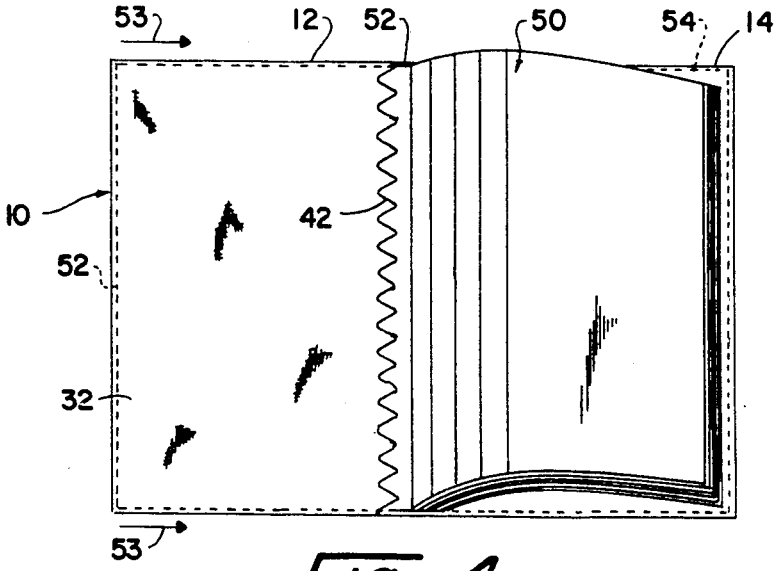
FIG. 4 is a perspective view of the book jacket of FIG. 1, with the front and back pouch sections thereof receiving the front and back covers of a book.
Figure 5:
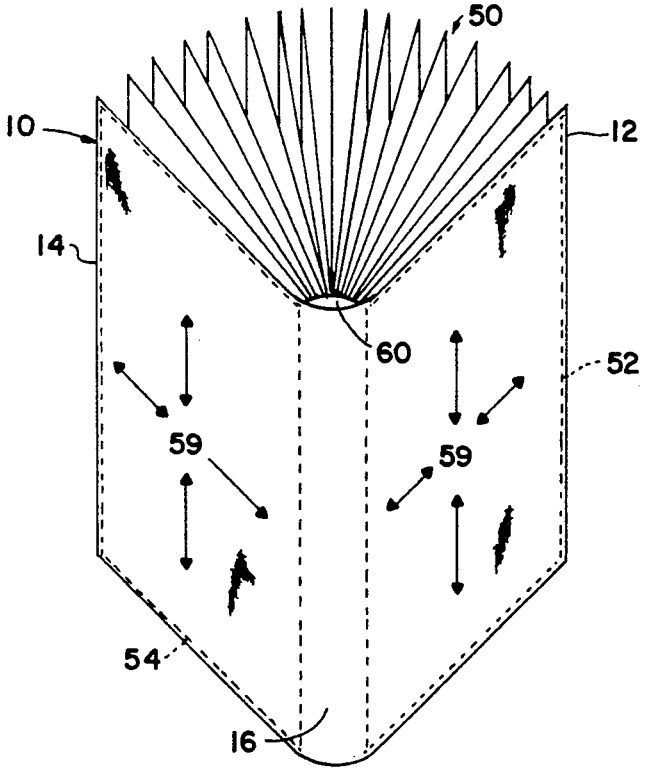
FIG. 5 is a perspective view of the book and book jacket of FIG. 4, with the outer cover part of the jacket being primarily depicted.

Jacket 10 is fitted onto a book 50, as shown in FIGS. 4 and 5. Cut edge segment 42 of first flap portion 32 is lifted away from the front cover part of jacket 10 and pouch section 12 is slipped onto the front cover 52 of book 50, in the direction of arrows 53, until the cover is snugly and conformably received in pouch section 12. At the same time, or subsequently, pouch section 14 is fitted in a similar manner onto the rear cover 54 of book 50. In one preferred assembly technique the front and rear book covers are opened until they are virtually parallel; the pouch sections 12 and 14 are then slipped gradually onto the respective covers.

As shown in FIG. 5, the elastic material in pouch sections 12 and 14 allows the pouches of jacket 10 to adjust in size and shape so that they snugly conform to the size and shape of covers 52 and 54. This adjustability is indicated by double headed arrows 59 in FIG. 5. Covers with differing thicknesses are also snugly enclosed. With jacket 10 fully and properly assembled on book 50, junction section 16 extends across and engages book binding 60. As book 50 is closed, section 16 is stretched across and maintains a snug engagement with the binding so that wear and tear on the binding is reduced. Because junction portion 16 is composed of the same elastic material as the pouch sections 12 and 14, it expands to accommodate various thicknesses of books and bindings.

To remove jacket 10 from book 50, book covers 52 and 54 are again opened as widely as possible so that they are virtually parallel. Pouch sections 12 and 14 are then removed from front and rear covers 52 and 54, respectively. Jacket 10 may then be employed with an entirely new book having a different size. If a somewhat larger or smaller book is to be covered the pouch sections will expand or contract, as shown by arrows 59, to assume the size and shape of that book. As a result, the time, expense and annoyance of purchasing and assembling an entirely new book jacket are eliminated.

Size is not a limitation of this invention and various sizes of jacket 10 may be employed. A particular jacket should be utilized for covering books which are at least as large as the jacket in its relaxed, unexpanded condition. Otherwise, the jacket is larger than the book and does not fit properly. For smaller books, a smaller jacket should be utilized. At the other extreme, the expandability of the jacket is limited by the elasticity of the material which is employed. For very large books, a somewhat larger jacket may be utilized. Nonetheless, a standard size jacket should be capable of accommodating most conventional school textbooks.

Figure 6:
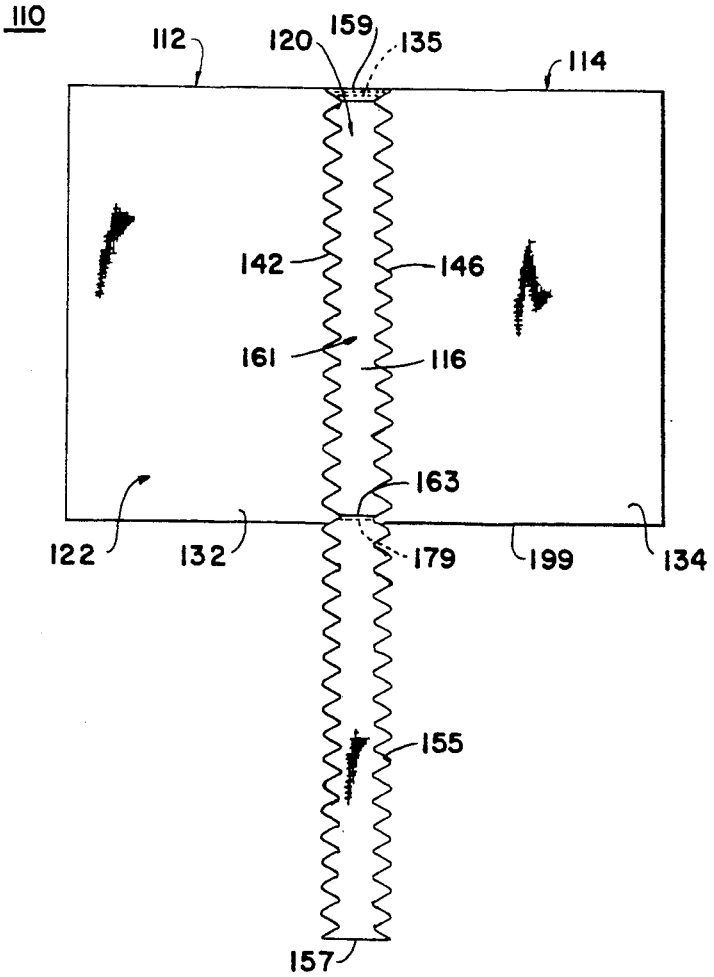
FIG. 6 is an elevational inside view of an alternative preferred book jacket in accordance with this invention, which book jacket includes an integral book marking element.
Figure 7:
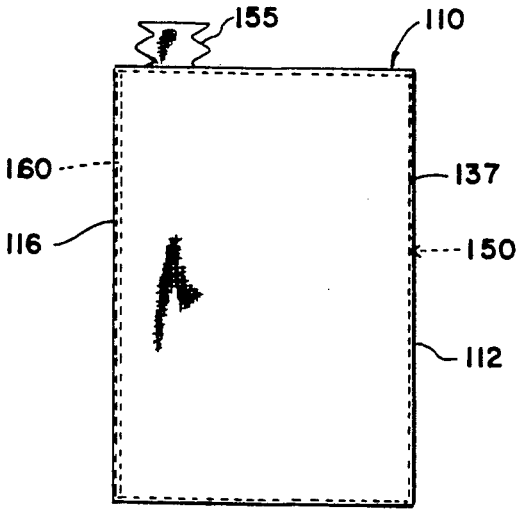
FIG. 7 is an elevational view of the front cover portion of the book jacket of FIG. 6 fitted onto a book to be covered, with the integral book mark disposed to designate an appropriate page of the book.

An alternative preferred book jacket 110 is shown in FIGS. 6 and 7. Jacket 110 includes a first pouch section 112 and a second pouch section 114, which are integrally interconnected by a junction section 116. More particularly, junction portion 116 interconnects front and rear cover portions of cover part 120. Pouch section 112 includes first cover portion 137, FIG. 7, and a corresponding flap portion 132, FIG. 6. Pouch section 114 similarly includes a second portion (not shown) of cover part 120 and a corresponding flap portion 134. As in the prior embodiment, the cover part 120 and the flap portions 132 and 134 may be formed by initially folding a single piece of elastic material to form generally conforming parts 120 and 122. These parts are then sewn or stitched together along their remaining peripheral edges. Such stitching is shown, for example, along seam 135. In this embodiment, parts 120 and 122 are folded along the lower edge 199 of jacket 110, although the location of the fold, and even the presence of a fold are not limitations of this invention.

In this embodiment, instead of simply making a single transverse cut to form the flaps and pouch sections, a pair of transverse cuts 142 and 146 are formed in the inside part 122 of the material. This forms an elongate book marking element 155 between flap sections 132 and 134. One end 157 of element 155 (which may comprise either the upper or lower end) is cut away or otherwise separated from the edge 159 of jacket 110. As a result, element 155 is selectively removable from between the pouch sections 112 and 114 to form a space 161 between flap portions 132 and 134. The opposite end 163 of element 155 remains fixed, typically integrally, to junction section 116. Reinforcement means, which include stitching 179, are provided along a portion of the lower edge 199 of jacket 10 for reinforcing attachment of marking element 155 to junction portion 116 of jacket 110. Stitched seam 135 reinforces the opposite edge of junction portion 116.

Jacket 110 is fitted onto a book 150, FIG. 7, in a manner similar to that described in the previous embodiment. Pouch section 112 accommodates the front cover of book 150 and pouch section 114 accommodates the rear cover. Junction section 116 conforms to and engages the binding 160 of the book. Elastic marking element 155 may be freely extended between any of the pages of the book to mark an appropriate portion in the text. Because it is permanently attached to jacket 110, it does not become separated from the jacket and therefore provides a reliable means for marking the reader's place in the book.

Although embodiments utilizing a single piece construction are described herein, alternative embodiments may employ two or more distinct, attachable pieces for the pouches, cover portions, flap portions, junction section and book marking element.

Accordingly, a number of benefits result from the book jacket of this invention. Because the jacket is durable, adjustable and reusable, it greatly reduces the time, expense and annoyance commonly associated with covering and often recovering school textbooks. And the product is environmentally advantageous because it will likely decrease the demand for inefficient paper book jackets, which tend to rapidly deteriorate and must be frequently discarded and replaced. The jacket of this invention may also carry a wide variety of aesthetically pleasing colors and designs which are popular with students.

Other embodiments will occur to those skilled in the art and are within the scope of the following claims.

What is claimed is:

1. An adjustable book jacket for a book having front and rear covers and a spine interconnecting the cover, said jacket comprising:

a first pouch section composed of an elastic material and having a first opening formed therein for receiving the front cover of the book and generally conforming to at least a portion of the periphery of the front cover;

a second pouch section composed of an elastic material and having a second opening formed therein for receiving the back cover of the book and generally conforming to at least a portion of the periphery of the back cover;

an elastic junction section integrally interconnecting said first and second pouch sections for extending across the spine of the book when said front and back covers are received by said first and second pouch sections, each pouch section including;

a generally sheet-like cover portion having a peripheral edge region, and a generally sheet-like flap portion having a first peripheral edge segment that generally conforms and is secured to said peripheral edge region of said cover portion, and a second peripheral edge segment that extends between upper and lower portions of said first peripheral edge segment and generally across said cover portion, a said second peripheral edge segment being separated from said cover section to form a respective one of said first and second pouch sections, said second peripheral edge segments being arranged generally parallel to one another and each extending fully across their respective cover portions without merging with each other, each peripheral edge region including substantially parallel upper and lower edge portions and a substantially linear side edge portion interconnecting said upper and lower edge portions, and said junction section including generally parallel upper and lower edges that are generally aligned, respectively, with said upper and lower edge portions of each peripheral edge region; and an elastic book marking element that is attached only to and depends from one of said upper and lower edges of said junction section.

2. The jacket of claim 1 in which said book marking element is composed of an elastic material and is attached integrally to said junction section.

3. The jacket of claim 1 in which at least a portion of said first peripheral edge segment is integrally connected to said peripheral edge region.

4. The jacket of claim 1 further including seam means for interconnecting at least a portion of said first peripheral segment and said peripheral edge region.

* * * * *